US009119999B2

(12) United States Patent
Cole et al.

(10) Patent No.: US 9,119,999 B2
(45) Date of Patent: Sep. 1, 2015

(54) GOLF CLUB HEADS WITH FREQUENCY MODULATION DEVICES AND RELATED METHODS

(71) Applicant: KARSTEN MANUFACTURING CORPORATION, Phoenix, AZ (US)

(72) Inventors: Eric V. Cole, Phoenix, AZ (US); Jeffrey A. Blankenship, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 264 days.

(21) Appl. No.: 13/762,643

(22) Filed: Feb. 8, 2013

(65) Prior Publication Data

US 2014/0228149 A1 Aug. 14, 2014

(51) Int. Cl.

| | |
|---|---|
| ***A63B 53/04*** | (2006.01) |
| ***A63B 53/06*** | (2006.01) |
| ***B23P 17/04*** | (2006.01) |
| ***B23K 20/12*** | (2006.01) |
| ***B23K 31/02*** | (2006.01) |

(52) U.S. Cl.

CPC ..... *A63B 53/0466* (2013.01); *A63B 53/047* (2013.01); *A63B 2053/0454* (2013.01); *A63B 2053/0458* (2013.01); *Y10T 29/49* (2015.01)

(58) Field of Classification Search

CPC ..... A63B 53/0466; A63B 2053/0458; A63B 2053/0454; A63B 53/047; Y10T 29/49

USPC ..... 473/324–350, 287–292, 409; 29/592; 228/114

See application file for complete search history.

(56) References Cited

U.S. PATENT DOCUMENTS

| | | | | |
|---|---|---|---|---|
| 4,932,658 | A * | 6/1990 | Antonious | 473/350 |
| 5,595,552 | A * | 1/1997 | Wright et al. | 473/332 |
| 5,669,829 | A * | 9/1997 | Lin | 473/346 |
| 5,709,615 | A * | 1/1998 | Liang | 473/324 |
| 5,908,357 | A * | 6/1999 | Hsieh | 473/327 |
| 6,454,665 | B2 * | 9/2002 | Antonious | 473/346 |
| 7,575,524 | B2 * | 8/2009 | Willett et al. | 473/342 |
| 8,070,623 | B2 * | 12/2011 | Stites et al. | 473/329 |
| 8,465,379 | B2 * | 6/2013 | Wada et al. | 473/329 |

* cited by examiner

*Primary Examiner* — Sebastiano Passaniti

(57) ABSTRACT

A golf club head including a strikeplate including strikeplate stiffness, a strikeface, and backface opposite the strikeface. The head also includes a modulation mechanism at the backface, a plurality of frequency modulators, and a plurality of anti-stiffening features interspersed between the plurality of frequency modulators. The plurality of frequency modulators reduces an oscillation frequency of the strikeplate upon impact with a golf ball. The plurality of anti-stiffening features permit flexing of the strikeplate between the plurality of frequency modulators.

23 Claims, 5 Drawing Sheets

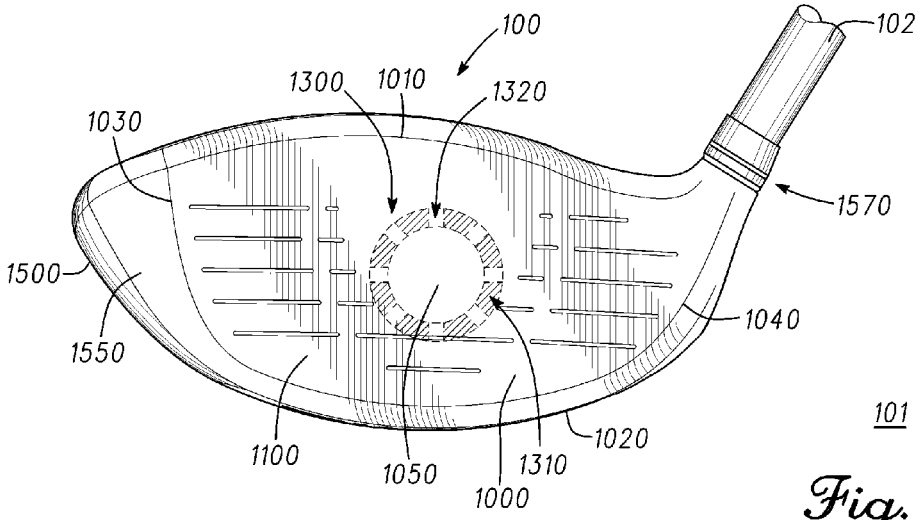
Fig. 1
Fig. 2
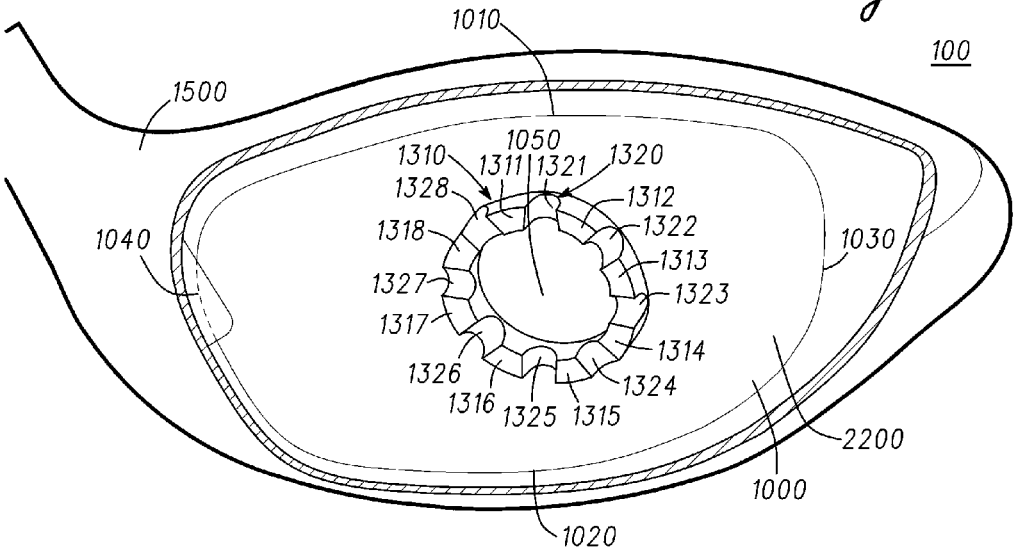

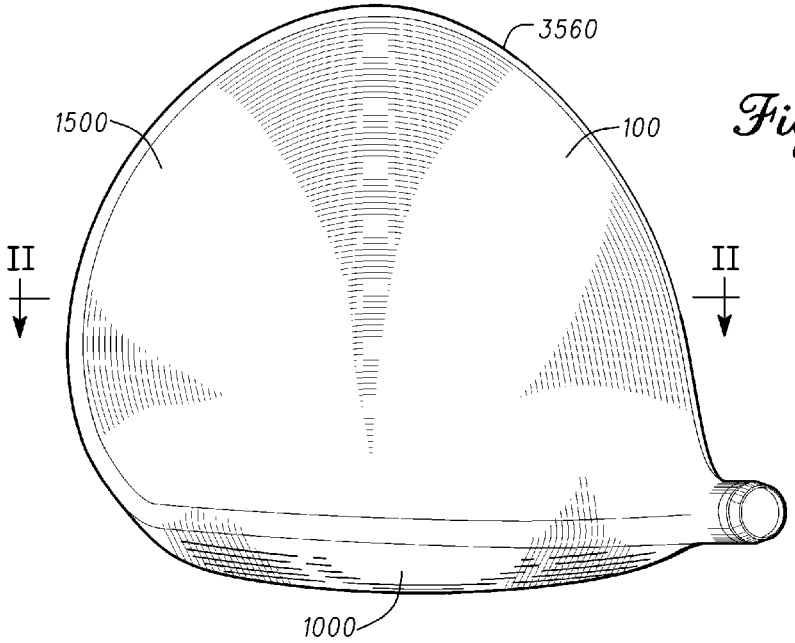
Fig. 3
Fig. 4
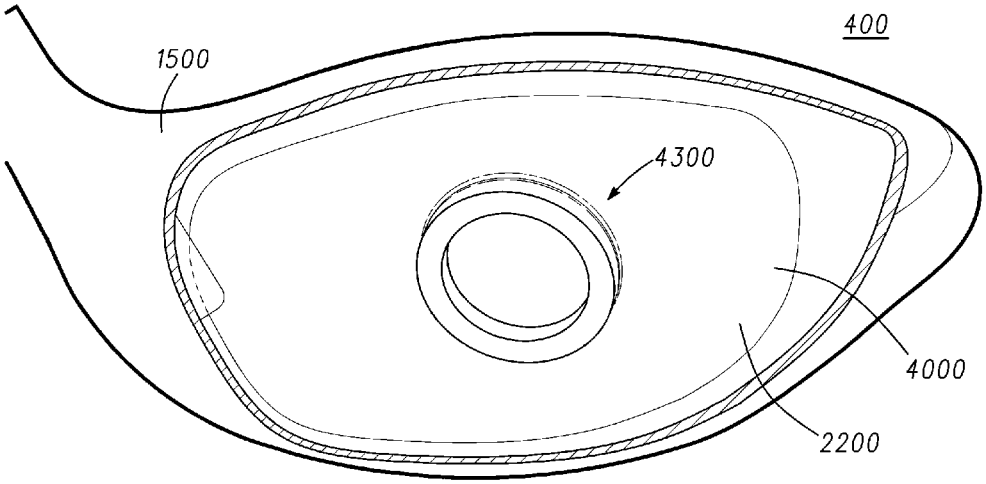

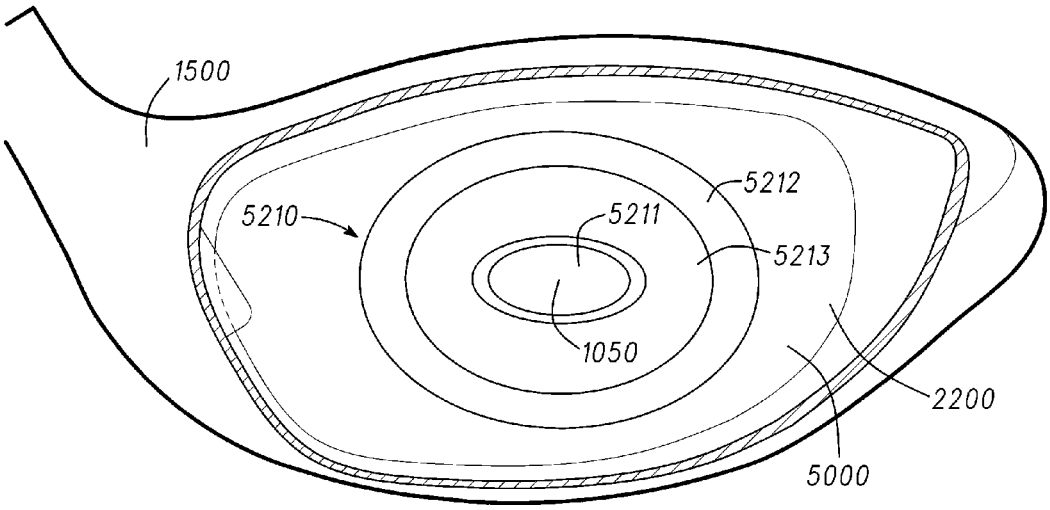
Fig. 5
Fig. 6
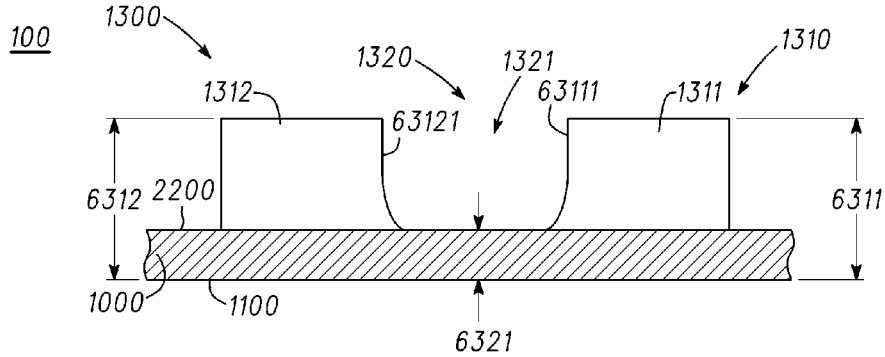
Fig. 7
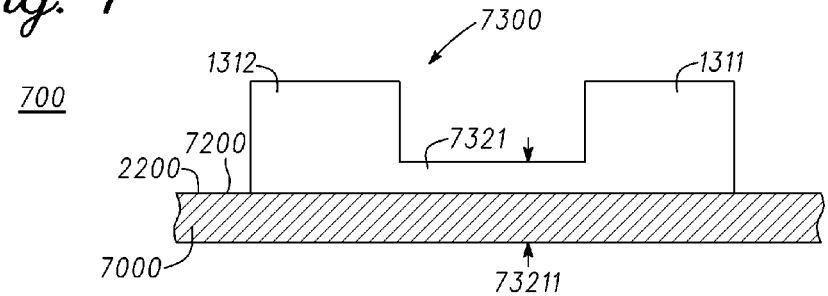

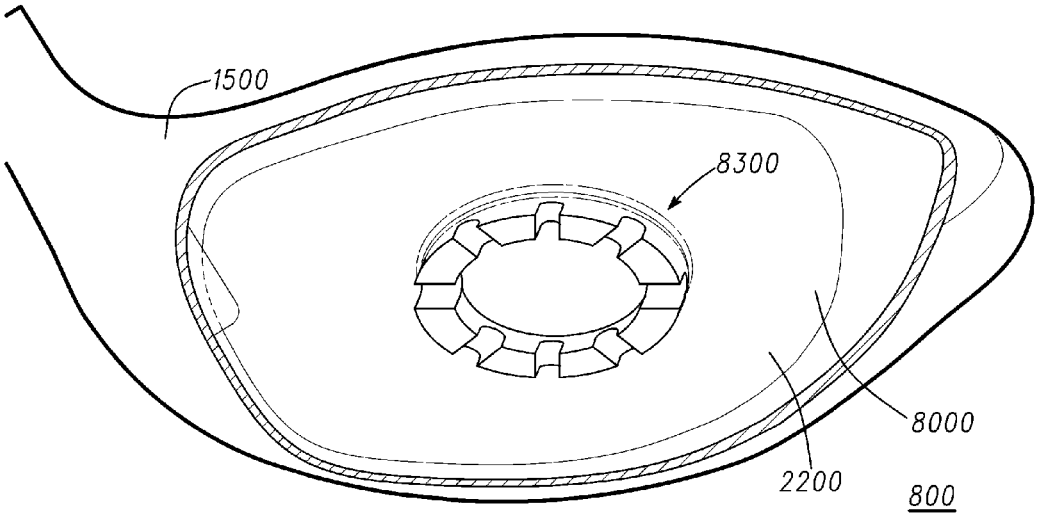
Fig. 8
Fig. 9
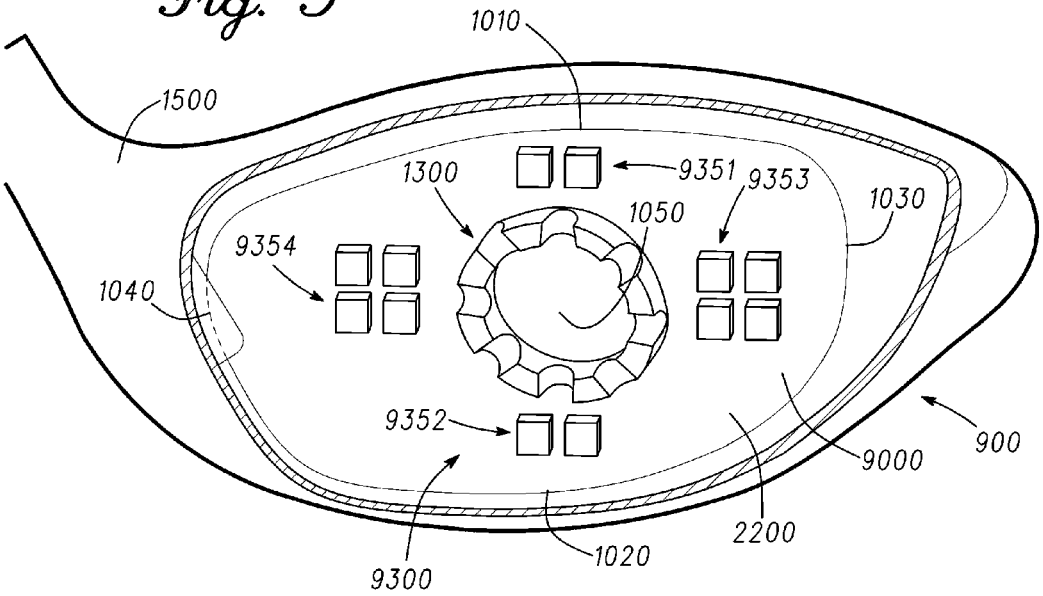

GOLF CLUB HEADS WITH FREQUENCY MODULATION DEVICES AND RELATED METHODS

TECHNICAL FIELD

The present disclosure relates generally to sports equipment, and relates, more particularly, to golf club heads with frequency modulation devices related methods.

BACKGROUND

During impact with a golf ball, the strikeface of the golf club head tends to be pushed back towards the rear of the golf club head before rebounding in the opposite direction towards the front of the golf club head. Such movement of the strikeface is measurable as a characteristic vibration frequency of the golf club head, and the rate at which the golf club head rebounds upon impact can affect the launch conditions and flight path of the golf ball off the strikeface. If such characteristic vibration frequency of the golf club head is not tuned properly, however, the rebounding strikeface may adversely affect the performance of the golf club head for launching the golf ball. If tuned properly, the rebound rate of the strikeplate may combine with the decompression rate of the golf ball to improve golf ball shot launch conditions.

Considering the above, further developments in frequency modulation devices for golf club heads and related methods will enhance the performance of golf clubs.

BRIEF DESCRIPTION OF THE DRAWINGS

The present disclosure may be better understood from a reading of the following detailed description of examples of embodiments, taken in conjunction with the accompanying figures.

FIG. 1 illustrates a front view of a golf club head having a frequency modulation mechanism.

FIG. 2 illustrates a cross-sectional rear perspective view of the golf club head of FIG. 1 along line II-II of FIG. 3, presenting a backface of the strikeplate of the golf club head along with the frequency modulation mechanism 1300.

FIG. 3 illustrates a top view of the golf club head of FIGS. 1-2.

FIG. 4 illustrates a cross-sectional rear perspective view of another golf club head, with a backface of its strikeplate having a mass pattern that is substantially continuous.

FIG. 5 presents a cross-sectional rear perspective view of a baseline golf club head, with a backface of its strikeplate lacking the mass pattern of FIG. 4 and lacking the modulation mechanism of FIGS. 1, 3.

FIG. 6 illustrates a side view of a portion of the frequency modulation mechanism of FIGS. 1-3 having weights thereof separated by an anti-stiffener.

FIG. 7 illustrates a side view of a portion of another frequency modulation.

FIG. 8 illustrates a cross-sectional rear perspective view of another golf club head, with a backface of its strikeplate having a modulation mechanism with an ellipse pattern.

FIG. 9 illustrates a cross-sectional rear perspective view of a further golf club head, with a backface of its strikeplate having a modulation mechanism set with multiple modulation mechanisms.

Figure 10:
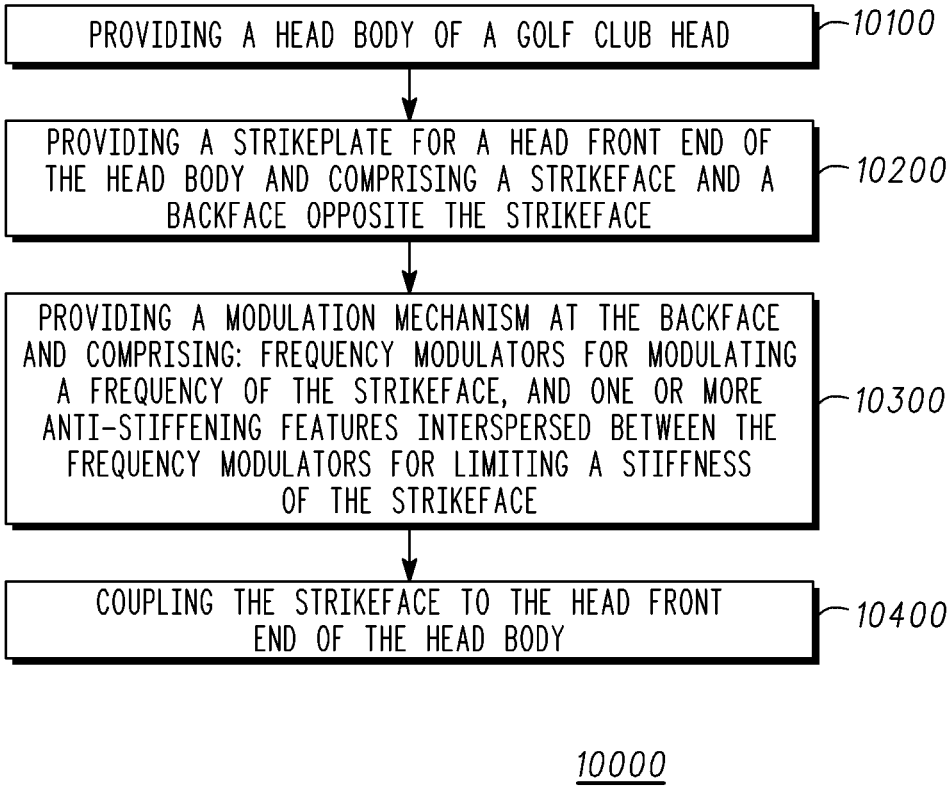
FIG. 10 illustrates a flowchart for a method to provide, form, and/or manufacture a golf club head in accordance with the present disclosure.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements, mechanically or otherwise. Coupling (whether mechanical or otherwise) may be for any length of time, e.g., permanent or semi-permanent or only for an instant.

The absence of the word "removably," "removable," and the like near the word "coupled," and the like does not mean that the coupling, etc. in question is or is not removable.

As defined herein, two or more elements are "integral" if they are comprised of the same piece of material. As defined herein, two or more elements are "non-integral" if each is comprised of a different piece of material.

DESCRIPTION

In one example, a golf club head can comprise a strikeplate comprising a strikeplate stiffness, a strikeface, a backface opposite the strikeface, and a modulation mechanism at the backface. The modulation mechanism can comprise a plurality of frequency modulators and a plurality of anti-stiffening features interspersed between the plurality of frequency modulators. The plurality of frequency modulators can reduce an oscillation frequency of the strikeplate upon impact with a golf ball. The plurality of anti-stiffening features can permit flexing of the strikeplate between the plurality of frequency modulators.

In one implementation, a method for providing a golf club head can comprise providing a head body providing a strikeplate for a head front end of the head body. Providing the strikeplate can comprise providing a strikeface and a backface opposite the strikeface. Providing the strikeplate can also comprise providing a modulation mechanism at the backface, the modulation mechanism comprising a plurality of frequency modulators and one or more anti-stiffening features located between the plurality of frequency modulators. The plurality of frequency modulators can reduce an oscillation frequency of the strikeplate upon impact with a golf ball. The one or more anti-stiffening features can permit flexing of the strikeplate between the plurality of frequency modulators.

In one embodiment, a golf club head can comprise a strikeplate comprising a strikeplate stiffness, a strikeface, a backface opposite the strikeface, and a modulation mechanism at the backface. The modulation mechanism can comprise a plurality of frequency modulators, and a plurality of anti-stiffening features interspersed between the plurality of frequency modulators. The plurality of frequency modulators and the plurality of anti-stiffening features can tune an oscillation frequency of the strikeplate upon impact with a golf ball to approximate and/or be within a target golf ball vibration frequency range of approximately 3000 Hz to approximately 4000 Hz.

Other examples and embodiments are further disclosed herein. Such examples and embodiments may be found in the figures, in the claims, and/or in the present description.

Turning to the drawings, FIG. 1 illustrates a front view of golf club head 100, having frequency modulation mechanism 1300 (shown in ghost) according to an embodiment. FIG. 2 illustrates a cross-sectional rear perspective view of golf club head 100 along line II-II of FIG. 3, presenting backface 2200 of strikeplate 1000 along with frequency modulation mechanism 1300. FIG. 3 illustrates a top view of golf club head 100.

Golf club head 100 comprises club head body 1500 and strikeplate 1000, where strikeplate 1000 has strikeplate top end 1010, strikeplate bottom end 1020, strikeplate heel end 1040, and strikeplate toe end 1030, and where club head body 1500 comprises hosel 1570, head front end 1550, and head rear end 3560 (FIG. 3) opposite front end 1550. Golf club head 100 is part of golf club 101 (FIG. 1), which also includes shaft 102 coupled to hosel 1570.

Strikeplate 1000 is located at front end 1550 of club head body 1500, and comprises strikeface 1100 facing an exterior of golf club head 100, and backface 2200 facing an interior of golf club head 100. Modulation mechanism 1300 is located at backface 2200 of strikeplate 1000, centered about centerpoint 1050 of strikeplate 1000 in the present example, and comprises frequency modulators 1310 and anti-stiffening features 1320 interspersed between frequency modulators 1310. Modulation mechanism 1300 can be arranged in many different patterns at backface 2200. For instance, in the present embodiment, modulation mechanism 1300 comprises a substantially circular pattern along which frequency modulators 1310 and anti-stiffening features 1320 are arranged in an alternating manner. Other patterns can be suitable as well in other embodiments, such as an elliptical pattern, an oval pattern, a hexagonal pattern, a grid pattern, and/or a combination of different patterns. In addition, modulation mechanisms similar to modulation mechanism 1300 may be located at other points of backface 2200, rather than centered about centerpoint 1050.

Modulation mechanism 1300 is configured to restrict an oscillation frequency of strikeplate 1000, while restricting at the same time an increase in a strikeplate stiffness of strikeplate 1000. For example the mass of frequency modulators 1310 can absorb or dampen the vibrations caused by impact between a golf ball and strikeface 1100, thereby causing a decrease in the oscillation frequency of strikeplate 1000, compared to an unmodulated oscillation frequency that strikeplate 1000 would exhibit without modulation mechanism 1300.

The ability to modulate the oscillation frequency of strikeplate 1000 via modulation mechanism 1300 can be useful, for example, when seeking to match or approximate a target golf ball vibration frequency range of one or more golf balls. In one example, the target ball vibration frequency range can be of approximately 3000 Hz to approximately 4000 Hz. If the oscillation frequency of strikeplate 1000 can be tuned so that, once flexed towards head rear end 3560 upon impact with the golf ball, strikeplate 1000 can rebound at a rate similar or closer to a decompression rate of the golf ball, then launch characteristics of golf club head 100, such as ball launch speed, can be improved.

The addition of a mass pattern at the backface of the strikeplate of the golf club can tend to stiffen the strikeplate, however, resulting in reduced flexing of the strikeface when impacting the ball, and even leading to an increase in the oscillation frequency of the strikeface due to the stiffness added by the mass pattern. Such stiffening effects can be referenced with respect to the embodiments of FIGS. 4-5. FIG. 4 illustrates a cross-sectional rear perspective view of golf club head 400 according to another embodiment, presenting backface 2200 of strikeplate 4000 having mass pattern 4300, which is substantially continuous and lacks anti-stiffening features like anti-stiffening features 1320 (FIG. 2). FIG. 5 presents a cross-sectional rear perspective view of a baseline golf club head 500, where backface 2200 of baseline strikeplate 5000 is devoid of mass pattern 4300 (FIG. 4) and of modulation mechanism 1300 (FIGS. 1, 3). In the present example, backface 2200 comprises a varying thickness 5210 that tapers from thick portion 5211 to shallow portion 5212 along and tapering portion 5213, where thick portion 5211 is thicker than shallow portion 5212 and is centered about centerpoint 1050 in the present example. Upon testing, the baseline oscillation frequency of baseline strikeplate 5000 (FIG. 5) was measured to be approximately 4,258 Hertz (Hz). This contrasts with the oscillation frequency of strikeplate 4000 with mass pattern 4300 (FIG. 4), which was measured to be approximately 4,280 Hz. Accordingly, the stiffness added to strikeplate 4000 by mass pattern 4300 increased the oscillation frequency of strikeplate 4000, negating the dampening of the oscillation frequency of strikeplate 4000 by the mass of mass pattern 4300, and resulting in a net increase in oscillation frequency rather than a reduction thereof.

Considering the above, modulation mechanism 1300 comprises interspersed anti-stiffening features 1320 as seen in FIG. 2 to permit flexing of strikeplate 1000 between frequency modulators 1310, thereby minimizing, prohibiting, or controlling increased stiffness in strikeplate 1000. When measured, the oscillation frequency of strikeplate 1000, was found to be of approximately 4,130 Hz, thus resulting in a reduction in oscillation frequency when compared to the oscillation frequency of baseline strikeface 5000 (FIG. 5).

Returning to the embodiment of FIGS. 1-3, frequency modulators 1310 comprise weights 1311-1318, while anti-stiffening features 1320 comprise anti-stiffeners 1321-1328 separating weights 1311-1318 from each other along a circular pattern. Although the present example shows eight weights and eight anti-stiffeners as listed above, there can be other embodiments with different numbers thereof. For example, one embodiment may comprise 6 weights interspersed with 6 anti-stiffeners. Other embodiments with more or less weights and/or anti-stiffeners are also possible. One embodiment may comprise two weights separated by one or two anti-stiffeners. In addition, other non-circular patterns may be implemented as well, such as a grid pattern of weights separated by anti-stiffeners.

FIG. 6 illustrates a side view of weights 1311 and 1312, separated by anti-stiffener 1321. Strikeplate 1000 comprises thickness 6311 through weight 1311, thickness 6312 through weight 1312, and thickness 6321 at or through anti-stiffener 1321, where thicknesses 6311, 6312, and 6321 are measured perpendicular to strikeface 1100. In the present example, each of thickness 6311 and thickness 6312 is greater than thickness 6321 and, because thickness 6321 is thinner by comparison, strikeface 1100 can more easily flex between weights 1311 and 1312, thereby minimizing or controlling an increase in the stiffness of strikeplate 1000. In addition, frequency modulators 1310 can be fully separated from each other by anti-stiffening features 1320 in the present embodiment. For instance, perimeter wall 63111 of weight 1311 is disconnected from perimeter wall 63121 of weight 1312, being fully separated from each other by anti-stiffener 1321 so that they do not pull against each other in a way that would increase the stiffness or restrict the flexing of strikeplate 1000 while strikeface 1100 impacts a golf ball.

Although in the present example thicknesses 6311 and 6312 are illustrated as being substantially the same, there can be other embodiments where they may differ from each other. For example, strikeplate 1000 can comprise a varying thickness contour in some embodiments, where the varying thickness contour can vary a thickness of strikeplate 1000, as measured between strikeface 1100 and backface 2200, along backface 2200 and. As an example, due to such varying thickness contour, strikeplate 1000 can be thicker towards the center of backface 2000 and/or can taper towards the perimeter thereof, where such varying thickness contour can vary differently towards strikeplate heel end 1040 and/or strikeplate toe end 1030 than towards the strikeplate top end 1010 and/or strikeplate bottom end 1020. In such cases, for instance, the thickness of strikeplate 1000 at the location of weight 1311 can thus differ from the thickness of strikeplate 1000 at the location of weight 1314, depending on the thickness contour of strikeplate 1000 along backface 2200. In the same or other examples, the thickness of only weight 1311 (without strikeplate 1000) may differ from the thickness of only weight 1312 (without strikeplate 1000) if desired, such as for defining a distribution of mass of modulation mechanism 1300.

In the present example, each anti-stiffener of anti-stiffener features 1320 comprises a gap between adjacent ones of the weights of frequency modulators 1310. For example, as seen in FIG. 6, anti-stiffener 1321 comprises a gap between weights 1311-1312, where thickness 6321 at the center of anti-stiffener 1321 is the thickness of strikeplate 1000 thereat. The thickness of one or more of the anti-stiffeners of anti-stiffener features 1320, such as thickness 6312 in FIG. 6, can conform to the thickness contour of strikeplate 1000 at the respective locations of such anti-stiffeners along backface 2200.

There can also be examples where one or more anti-stiffener features can protrude from the backface of the strikeface between one or more frequency modulators. FIG. 7 illustrates a side view of a portion of modulation mechanism 7300 of strikeplate 7000 of golf club head 700 according to another embodiment, where weights 1311 and 1312 are separated by anti-stiffener 7321. In some examples, golf club head 700 with strikeplate 7000 can be similar to golf club head 100 with strikeplate 1000 (FIGS. 1-3, 6). Modulation mechanism 7300 can be similar to modulation mechanism 1300 (FIGS. 1, 3, 6), such that anti-stiffener 7321 can be similar to anti-stiffener 1321. In the example of FIG. 7, however, anti-stiffener 7321 protrudes from backface 7200 such that thickness 73211 at a center of anti-stiffener 7321 is greater than the thickness of only strikeplate 7000 thereat.

As can be seen in FIGS. 6-7, transitions between weights and anti-stiffeners can comprise different shapes. For example, as seen in FIGS. 2 and 6, the transitions from weights 1311 and 1312 to anti-stiffener 1321 are arcuate towards backface 2200. In contrast, as seen in FIG. 7, the transitions from weights 1311 and 1312 to anti-stiffener 7321 towards backface 2200 are abruptly angled rather than arcuately contoured. There can be other examples where transition(s) and/or anti-stiffener(s) in a modulation mechanism may be concave or convex relative to the backface of the strikeplate.

FIG. 8 illustrates a cross-sectional rear perspective view of golf club head 800 according to further embodiment, where backface 2200 of strikeplate 8000 having modulation mechanism 8300 similar to modulation mechanism 1300 (FIGS. 1, 3), but having an elliptical pattern rather than a circular pattern. There can be other embodiments with similar modulation mechanisms having different geometric patterns, such as a line, a polygon, a hyperbola, a spiral, a semicircle, a star, a cross, and/or one or more combinations thereof, among others.

FIG. 9 illustrates a cross-sectional rear perspective view of golf club head 900 according to yet another embodiment, presenting backface 2200 of strikeplate 9000 having compound modulation mechanism 9300. Compound modulation mechanism 9300 can be similar to one or more of the modulation mechanisms described above, but comprises more than one modulation mechanism at backface 2200. For example, compound modulation mechanism 9300 comprises modulation mechanisms 1300 and 9351-9354. In the present example, modulation mechanism 1300, as described above with respect to FIGS. 1 and 3, is incorporated as part of compound modulation mechanism 9300. Modulation mechanisms 9351-9352 comprise an anti-stiffener feature interspersed between frequency modulators arranged along a line pattern, and modulation mechanisms 9353-9354 comprise anti-stiffener features interspersed between frequency modulators arranged in a grid pattern. Accordingly, the layouts of modulator mechanisms 1300, 9351-9352, and 9353-9354 are different from each other, but there can be other embodiments having all of its modulator mechanisms with the same or similar layouts. Also, there can be other embodiments with modulator mechanism(s) similar to compound modulator mechanism 9300, but having a different number of modulator mechanisms and/or having modulator mechanisms with layouts different than those of modulator mechanisms 1300 and/or 9351-9354.

In the present embodiment of FIG. 9, modulator mechanism 1300 is located centered about centerpoint 1050 of strikeplate 9000. Modulation mechanism 9351 is located above modulation mechanism 1300, centered between centerpoint 1050 and strikeplate top end 1010. Modulation mechanism 9352 is located below modulation mechanism 1300, centered between centerpoint 1050 and strikeplate bottom end 1020. Modulation mechanism 9353 is located at one side of modulation mechanism 1300, centered between centerpoint 1050 and strikeplate toe end 1030. Modulation mechanism 9354 is located at an opposite side of modulation mechanism 1300, centered between centerpoint 1050 and strikeplate heel end 1040.

There can be other embodiments, however, that can comprise a subset of one or more of the modulator mechanisms of compound modulator mechanism 9300. As an example, one embodiment can comprise a modulation mechanism like modulation mechanism 9351 and/or located similar thereto towards strikeface top end 1010 (and without modulation mechanism 9352). Such modulation mechanism can increase the effective loft of the strikeface 1100 (FIG. 1) by reducing the rebound speed of the top section of the strikeface to be slower than that of the bottom section of the strikeface, which can result in the bottom section of the strikeface having relatively greater pushing effect on the golf ball than the top section of the strikeface, and/or which can result in higher ball speed on golf shots where the golf ball is impacted by the bottom section of the strikeface.

As another example, one embodiment can comprise a modulation mechanism like modulation mechanism 9352 and/or located similar thereto towards strikeface bottom end 1020 (and without modulation mechanism 9351). Such modulation mechanism can decrease the effective loft of strikeface 1110 (FIG. 1) by reducing the rebound speed of the bottom section of the strikeface to be slower than that of the top section of the strikeface, which can result in the top section of the strikeface having relatively greater pushing effect on the golf ball than the bottom section of the strikeface, and/or which can result in higher ball speed on golf shots where the golf ball is impacted by the top section of the strikeface.

As another example, one embodiment can comprise a modulation mechanism like modulation mechanism 9353 and/or located similar thereto towards strikeface toe end 1030 (and without modulation mechanism 9354). Such modulation mechanism can reduce the rebound speed of the toe section of the strikeface to be slower than that of the heel section of the strikeface, which can result in the heel section of the strikeface having relatively greater pushing effect on the golf ball than the toe section of the strikeface, and/or which can result in higher ball speed on golf shots where the golf ball is impacted by the heel section of the strikeface.

As another example, one embodiment can comprise a modulation mechanism like modulation mechanism 9354 and/or located similar thereto towards strikeface heel end 1040 (and without modulation mechanism 9353). Such modulation mechanism can reduce the rebound speed of the heel section of the strikeface to be slower than that of the toe section of the strikeface, which can result in the toe section of the strikeface having relatively greater pushing effect on the golf ball than the heel section of the strikeface, and/or which can result in higher ball speed on golf shots where the golf ball is impacted by the toe section of the strikeface.

Dimensions of the different elements of the modulation mechanisms described herein may vary depending on the specific embodiment. For example, with respect to modulation mechanism 1300 (FIGS. 1, 3, 6), one or more of the weights of frequency modulators 1310, such as weight 1311, may comprise a height of approximately 1 mm to approximately 1 mm over backface 2200, measured perpendicular to strikeface 1110, and/or may comprise a width of approximately 2 mm to approximately 5 mm and a length of approximately 2 mm to approximately 5 mm measured parallel to strikeface 1110. Also, the outer diameter of modulation mechanism 1300 can be approximately 1.2 cm to approximately 2.5 cm, and the inner diameter of modulation mechanism 1300 can be approximately 1 cm to approximately 2.3 cm. In the same or other examples, one or more of the anti-stiffeners of anti-stiffening features 1320, such as anti-stiffener 1321, may comprise a height of approximately 0 mm to approximately 1 mm over backface 2200, measured perpendicular to strikeface 1110, and/or may comprise a width of approximately 2 mm to approximately 5 mm and a length of approximately 2 mm to approximately 5 mm measured parallel to strikeface 1110. In addition, strikeplate 1100 may comprise a strikeface thickness of approximately 2 mm to approximately 4 mm measured perpendicular to strikeface 1110, where such strikeface thickness may vary depending on the thickness contour of strikeplate 1000 along backface 2200. Accordingly, the height of frequency modulators such as weight 1311, relative to the thickness of strikeplate 1000, may range from approximately 25% to approximately 300%.

Based on the different configurations described herein, different effects may be achieved with respect to the oscillation frequency and/or the stiffness of a strikeface via a modulation mechanism similar to those described herein or variations thereof. In some implementations, the modulation mechanism can decrease an oscillation frequency of the strikeplate by at least approximately 0.5%, without increasing the stiffness of the strikeplate by more than 8%. In the same or other embodiments, the modulation mechanism can decrease the oscillation frequency by at least approximately 20 Hz without undue increase in the stiffness of the strikeplate. For instance, as described above, modulation mechanism 1300 (FIG. 1) decreased the oscillation frequency of strikeplate 1000 to approximately 4130 HZ when compared to the oscillation frequency of 4258 Hz for baseline strikeplate 5000 (FIG. 5), thus resulting in an oscillation frequency reduction of at least 100 Hz. There can be examples where the modulation mechanism can adjust the oscillation frequency of the strikeplate to less than approximately 4280 Hz, and/or to within approximately 5% to approximately 25% of a target golf ball vibration frequency of approximately 3,000 Hz to approximately 4,000 Hz.

The stiffness of the strikeplate can relate in some embodiments to the deflection distance that the strikeface is deflected upon impact with a golf ball. To analyze how the proposed modulation mechanisms with anti-stiffener features can limit detrimental effects on strikeface stiffness, a comparison of was carried out between baseline strikeplate 5000 (FIG. 5), strikeplate 4000 with mass pattern 4300 lacking anti-stiffening features (FIG. 4), and strikeplate 1000 with frequency modulation mechanism 1300 having anti-stiffening features 1320 (FIG. 1) with respect to the strikeface deflection distance for such strikeplates upon impact with a golf ball. Such analysis was performed with respect to a centered golf impact at respective centerpoints of the strikefaces of strikeplate 1000 (FIGS. 1-3, 6), strikeplate 4000 (FIG. 4), and strikeplate 5000 (FIG. 5), with a golf ball of approximately 56 grams and at a speed of approximately 53.6 meters per second. Under such conditions, baseline strikeplate 5000 deflected approximately 3.12 mm, strikeplate 4000 (FIG. 4) deflected approximately 2.18 mm, and strikeplate 5000 with anti-stiffener features 1320 (FIG. 5) deflected approximately 2.87 mm. Accordingly, due to anti-stiffener features 1320*m* strikeplate 1000 (FIGS. 1-3, 6) was able to deflect approximately 30% more than strikeplate 4000 (FIG. 4), and deflected only approximately 8% less than baseline strikeplate 5000 (FIG. 5) while still adjusting its oscillation frequency as described above.

FIG. 10 illustrates a flowchart for method 10000, which can be used to provide, form, and/or manufacture a golf club head in accordance with the present disclosure. In some examples, the golf club head can be similar to golf club head 100 (FIGS. 1-6), golf club head 700 (FIG. 7), golf club head 800 (FIG. 8), and/or golf club head 900 (FIG. 9).

Method 10000 comprises block 10100 for providing a head body of a golf club head. In some examples, the head body can be a driver-type body similar to club head body 1500 (FIGS. 1-5, 8-9) of golf club heads described above. In a different embodiment, the head body can be one of a fairway wood type, a hybrid type, an iron type, and/or a putter type.

Method 10000 also comprises block 10200 for providing a strikeplate for a head front end of the head body and comprising a strikeface and a backface opposite the strikeface. In some examples, the strikeplate can be similar to strikeplate 1000 (FIGS. 1-3, 6), strikeplate 4000 (FIG. 4), strikeplate 5000 (FIG. 5), strikeplate 7000 (FIG. 7), strikeplate 8000 (FIG. 8), strikeplate 9000 (FIG. 9), or variations thereof. The strikeplate may also be one of a fairway wood strikeplate, a hybrid head strikeplate, an iron head strikeplate, and/or a putter head strikeplate.

Block 10300 of method 10000 comprises providing a modulation mechanism at the backface. The modulation mechanism comprises frequency modulators for modulating a frequency of the strikeplate, and one or more anti-stiffening features interspersed between the frequency modulators for limiting a stiffness of the strikeplate. In some examples, the modulation mechanism can be similar to one or a combination of the modulation mechanisms described herein with respective frequency modulators and anti-stiffening features. For example, the modulation mechanism can be similar to modulation mechanism 1300 (FIGS. 1-2, 6), modulation mechanism 7300 (FIG. 7), modulation mechanism 8300 (FIG. 8), compound modulation mechanism 9300 (FIG. 9), and/or variations thereof.

The modulation mechanism may be coupled to the backface in different ways.

For example, the modulation mechanism may be coupled to the backface via a casting process as a single cast piece. As another example, the modulation mechanism may be forged from a single forged piece along with the backface. In the same or other examples, the modulation mechanism may be machined at the backface via one or more machining tools such as a form cutter or an end mill, whether flat or radiused. In other examples the modulation mechanism may be welded or brazed to the backface. There can also be examples where the modulation mechanism may be friction-welded to the backface. For instance, a modulator ring may be spun over the backface to generate a friction-weld bond therebetween. In some examples, the modulator ring may be similar to pattern 4300 in FIG. 4 after being friction-welded to backface 2200. Then, anti-stiffening features 1320 and edges of adjacent frequency modulators 1310 can be formed by machining material off the modulator ring, such as with an end mill or form cutter.

Block 10400 of method 10000 comprises coupling the strikeplate to the head front end of the head body. In some examples, the strikeplate can be coupled via a weld bead joining a perimeter of the strikeplate to the head front end of the head body. Block 10400 can be optional in some implementations, such as where the head body already comprises the strikeplate as an integral part of its head front end.

In some examples, one or more of the different blocks of method 10000 can be combined into a single block or performed simultaneously, and/or the sequence of such blocks can be changed. For example, in some embodiments, blocks 10200 and 10300 can be combined, such as where the strikeplate and the modulation mechanism are concurrently formed via casting or forging. In the same or other examples, some of the blocks of method 10000 can be subdivided into several sub-blocks. For example, block 10100 can be subdivided into several sub-blocks for providing different parts of the head body of the golf club head. There can also be examples where method 10000 can comprise further or different blocks. As an example, method 10000 may comprise another block for providing or coupling a shaft to head body of block 10100. In addition, there may be examples where method 10000 can comprise only part of the blocks described above. For example, block 10400 may be optional in some implementations. Other variations can be implemented for method 10000 without departing from the scope of the present disclosure.

Although the golf club heads with frequency modulation devices and related methods herein have been described with reference to specific embodiments, various changes may be made without departing from the spirit or scope of the present disclosure. As an example, although anti-stiffening features 1320 are shown in FIG. 2 as comprising a substantially "U" shape, there may be embodiments where anti-stiffening features 1320 can comprise other shapes, such as a substantially "V" shape or a "squared-U" shape with substantially square corners. Additional examples of such changes and others have been given in the foregoing description. Other permutations of the different embodiments having one or more of the features of the various figures are likewise contemplated. Accordingly, the specification, claims, and drawings herein are intended to be illustrative of the scope of the disclosure and is not intended to be limiting. It is intended that the scope of this application shall be limited only to the extent required by the appended claims.

The golf club heads with frequency modulation devices and related methods discussed herein may be implemented in a variety of embodiments, and the foregoing discussion of certain of these embodiments does not necessarily represent a complete description of all possible embodiments. Rather, the detailed description of the drawings, and the drawings themselves, disclose at least one preferred embodiment, and may disclose alternative embodiments.

All elements claimed in any particular claim are essential to the embodiment claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a driver-type golf club, the apparatus, methods, and articles of manufacture described herein may be applicable to other types of golf club such as a fairway wood-type golf club, a hybrid-type golf club, an iron-type golf club, a wedge-type golf club, or a putter-type golf club.

Alternatively, the apparatus, methods, and articles of manufacture described herein may be applicable to other type of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

The invention claimed is:

1. A golf club head comprising:
a strikeplate comprising:
a strikeplate stiffness;
a strikeface;
a backface opposite the strikeface; and
a modulation mechanism at the backface;
wherein:
the modulation mechanism comprises:
a plurality of frequency modulators comprising a first weight and a second weight; and
a plurality of anti-stiffening features interspersed between the plurality of frequency modulators;
the plurality of frequency modulators reduce art oscillation frequency of the strikeplate upon impact with a golf ball; and
the plurality of anti-stiffening features permit flexing of the strikeplate between the plurality of frequency modulators;
the strikeplate comprises:
a first thickness through the first weight measured perpendicular to the strikeface;
a second thickness through the second weight measured perpendicular to the strikeface, and
the first and second thicknesses are different from each other.

2. The golf club head of claim 1, wherein:
the plurality of anti-stiffening features comprise:
a first anti-stiffening feature separating the first and second weights from each other;
the strikeplate comprises:
a third thickness through the first anti-stiffening feature, measured perpendicular to the strikeface;
the first thickness is greater than the third thickness; and
the second thickness is greater than the third thickness.

3. The golf club head of claim 1, wherein:
the plurality of anti-stiffening features comprise:
a first anti-stiffening feature separating the first and second weights from each other;
and
the strikeplate comprises:
a thickness pattern noninclusive of the modulation mechanism;
and
a third thickness through the first anti-stiffening feature, measured perpendicular to the strikeface, and conforming to the thickness pattern of the strikeplate.

4. The golf club head of claim 1, wherein:
the plurality of anti-stiffening features comprise:
a first anti stiffening feature separating the first and second weights from each other;
a transition between the first weight and the first anti-stiffening feature is arcuate towards the backface; and
a transition between the second weight and the first anti-stiffening feature is arcuate towards the backface.

5. The golf dub head of claim 1, wherein:
the plurality of anti-stiffening feature protrude from the backface of the strikeface.

6. The golf club head of claim 1, wherein:
each of the plurality of anti-stiffening features comprises a gap between adjacent ones of the plurality of frequency modulators.

7. The golf club head of claim 1, wherein:
each of the plurality of frequency modulators comprises perimeter wall; and
all of the perimeter walls of the plurality of frequency modulators are disconnected from each other.

8. The golf club head of claim 1, wherein:
the modulation mechanism comprises at least one of:
a circular pattern, a line pattern, an elliptical pattern, polygonal pattern, a hyperbolic pattern, a spiral pattern, a semicircular pattern, star pattern, a cross pattern, or a grid pattern.

9. The golf club head of claim 1, wherein:
the modulation mechanism decreases the oscillation frequency of the strikeplate by at least approximately 20 Hz.

10. The golf club head of claim 1, wherein:
the strikeplate with the modulation mechanism comprises an oscillation frequency of less than approximately 4780 Hz.

11. The golf club head of claim 1, wherein:
a strikeface deflection distance for the strikeface of the strikeplate with the modulation mechanism is greater than approximately 2.18 mm,
the strikeface deflection distance measured with respect to a centered golf impact at a centerpoint of the strikeface with a golf ball of approximately 56 grams and at a speed of approximately 53.6 meters per second.

12. The golf club head of claim 1, wherein:
the modulation mechanism is at least one of:
located between a centerpoint of the strikeplate and a top end of the strikeplate; or
located between the centerpoint of the strikeplate and a bottom end of the strikeplate.

13. The golf club head of claim 1, wherein:
the modulation mechanism is centered about a centerpoint of strikeplate.

14. The golf club head of claim 1, wherein:
the modulation mechanism is at least one of:
located between a centerpoint of the strikeplate and a heel end of the strikeplate; or
located between the centerpoint of the strikeplate and a toe end of the strikeplate.

15. The golf club head of claim 1, wherein:
the strikeplate further comprises:
a second modulation mechanism at the backface;
the first modulation mechanism is located at one of:
a centerpoint of the strikeplate;
a location between the centerpoint and a top end of the strikeplate;
a location between the centerpoint and a bottom end of the strikeplate;
a location between the centerpoint and a heel end of the strikeplate; or
a location between the centerpoint and toe end of the strikeplate;
and
the second modulation mechanism is located at different one of:
the centerpoint of the strikeplate;
the location between the centerpoint and a top end the strikeplate;
the location between the centerpoint and a bottom end of the strikeplate;

the location between the centerpoint and a heel end of the strikeplate; or the location between the centerpoint and end of the strikeplate.

16. The golf club head of claim 1, wherein:

the strikeplate further comprises a second modulation mechanism at the backface; and the second modulation mechanism comprises a layout different than a layout of the modulation mechanism.

17. The golf club head of claim 1, wherein:

a target golf ball vibration frequency range approximately 3000 Hz to approximately 4000 Hz, and the strikeplate with the modulation mechanism comprises frequency within approximately 25% of the target golf ball vibration frequency range.

18. The golf club head of claim 1, wherein:

a target golf ball vibration frequency range is approximately 3000 Hz to approximately 4000 Hz and the strikeplate with the modulation mechanism comprises an oscillation frequency within approximately 5% of the target golf ball vibration frequency range.

19. A golf club head comprising:

a strikeplate comprising:

a strikeplate stiffness;

a strikeface;

a backface opposite the strikeface; and a modulation mechanism at the backface;

wherein:

the modulation mechanism comprises:

a plurality of frequency modulators; and a plurality of anti-stiffening features interspersed between the plurality of frequency modulators;

the plurality of frequency modulators reduce an oscillation frequency of the strikeplate upon impact with a golf ball; and the plurality of anti-stiffening features permit flexing of the strikeplate between the plurality of frequency modulators;

at least one of the plurality of frequency modulators comprises at least one of:

a thickness of approximately 1 mm to approximately 6 mm; or a width of approximately 2 mm to approximately 5 mm;

and at least one the plurality of anti-stiffening features comprises at least one of:

a thickness of approximately 0 mm to approximately 1 mm; or a width of approximately 1 mm to approximately 5 mm.

20. A golf club head comprising:

a strikeplate comprising:

a strikeplate stiffness;

strikeface;

a backface opposite the strikeface; and a modulation mechanism at the backface;

wherein:

the modulation mechanism comprises:

a plurality of frequency modulator; and a plurality of anti-stiffening features interspersed between the plurality of frequency modulators;

the plurality of frequency modulators reduce an oscillation frequency of the strikeplate upon impact with a golf ball; and the plurality of anti-stiffening features permit flexing of the strikeplate between the plurality of frequency modulators;

at least one of the plurality of frequency modulators comprises at least one of:

a thickness of approximately 1 mm to approximately 6 mm; or a width of approximately 2 mm to approximately 5 mm;

at least one of the plurality of anti-stiffening features comprises at least one of:

a thickness of approximately 0 mm to approximately 1 mm; or a width of approximately 1 mm to approximately 5 mm;

and a maximum thickness of the strikeplate is of approximately 2 mm to approximately 4 mm.

21. A method for providing a golf club head, the method comprising:

providing a head body; and providing a strikeplate for a head front end of the head body;

wherein:

providing the strikeplate comprises:

providing a strikeface and a backface opposite the strikeface; and providing a modulation mechanism at the backface and comprising:

a plurality of frequency modulators; and one or more anti-stiffening features located between the plurality of frequency modulators;

the plurality of frequency modulators reduce an oscillation frequency of the strikeplate upon impact with a golf ball; and the one or more anti-stiffening features permit flexing of the strikeplate between the plurality of frequency modulators;

the plurality of frequency modulators comprise:

a first weight; and a second weight;

the one or more anti-stiffening features comprise:

a first anti-stiffening feature separating the first and second weights from each other;

the strikeplate comprises:

a first thickness through the first weight, measured perpendicular to the strikeface;

a second thickness through the second weight measured perpendicular to the strikeface;

and a third thickness through the first anti-stiffening feature measured perpendicular to the strikeface;

the first thickness is greater than the third thickness;

the second thickness is greater than the third thickness;

providing the modulation mechanism comprises at least one of:

coupling at least as portion of the modulation mechanism to the backfire via at least one of:

a weld material; or a friction weld bond;

casting the modulation mechanism as a single cast piece with the strikeplate; or forging the modulation mechanism as a single forged piece with the strikeplate;

each of the plurality of frequency modulators comprises a perimeter wall; and all perimeter walls of the plurality of frequency modulators are disconnected from each other.

22. A method for providing a golf club head, the method comprising:

providing a head body; and providing a strikeplate for a head front end of the head body;

wherein providing the strikeplate comprises:

providing a strikeface and a backface opposite the strikeface; and providing a modulation mechanism at the backface and comprising:

a plurality of frequency modulators; and one or more anti-stiffening features located between the plurality of frequency modulators;

the plurality of frequency modulators reduce an oscillation frequency of the strikeplate upon impact with a golf ball; and the one or more anti-stiffening features permit flexing of the strikeplate between the plurality of frequency modulators;

providing the modulation mechanism comprises:

friction-welding a modulator ring to the backface of the strikeplate; and machining material off a first location of the modulator ring to define:

a first anti-stiffening feature of the one or more and-stiffening features;

an edge of a first weight of the plurality of frequency modulators; and an edge of a second weight of the plurality of frequency modulators.

23. A golf club head comprising:

strikeplate comprising:

strikeplate stiffness;

a strikeface;

a backface opposite the strikeface; and a modulation mechanism at the backface;

wherein:

the modulation mechanism comprises:

a plurality of frequency modulators; and a plurality of anti-stiffening features interspersed between the plurality of frequency modulators;

and the plurality of frequency modulators and the plurality of anti-stiffening features tune an oscillation frequency of the strikeplate upon impact with a golf ball to be within approximately 25% of a target golf ball vibration frequency range of approximately 3000 Hz to approximately 4000 Hz;

the plurality of frequency modulators comprise:

a first weight; and a second weight;

the plurality of anti-stiffening features comprise:

a first anti-stiffening feature separating the first and second weights from each other;

the strikeplate comprises:

a first thickness through the first weight, measured perpendicular to the strikeface;

a second thickness through the second weight, measured perpendicular to the strikeface;

and a third thickness through the first anti-stiffening feature, measured perpendicular to the strikeface;

the first thickness is greater than the third thickness;

the second thickness is greater than the third thickness;

the first weight comprises at least one of:

a thickness of approximately 1 mm to approximately 6 mm; or a width of approximately 2 mm to approximately 5 mm;

the first anti-stiffening feature comprises at least one of:

a thickness of approximately 0 mm to approximately 1 mm; or a width of approximately 2 mm to approximately 5 mm;

a maximum thickness of the strikeplate is of approximately 2 mm to approximately 4 mm;

a transition between the first weight and the first anti-stiffening feature is arcuate towards the backface;

a transition between the second weight and the first anti-stiffening feature is arcuate towards the backface;

each of the plurality of frequency modulators comprises a perimeter wall;

all perimeter walls of the plurality of frequency modulators are disconnected from each other;

the modulation mechanism is centered about a centerpoint of the strikeplate; and the modulation mechanism tunes the oscillation frequency of the strikeface to be within approximately 5% of the target golf ball vibration frequency.

* * * * *